US005284245A

United States Patent [19]

Slivon et al.

[11] Patent Number: 5,284,245

[45] Date of Patent: Feb. 8, 1994

[54] PORTABLE SOCKET HOLDER

[75] Inventors: George R. Slivon, Kenosha; Kenneth C. Happ, Burlington, both of Wis.

[73] Assignee: Snap-on Tools Corporation, Kenosha, Wis.

[21] Appl. No.: 63,355

[22] Filed: May 19, 1993

Related U.S. Application Data

[63] Continuation of Ser. No. 856,362, Mar. 23, 1992, abandoned.

[51] Int. Cl.[5] ..... B65D 85/28

[52] U.S. Cl. ..... 206/378; 206/493; 206/565; 211/70.6

[58] Field of Search ..... 206/374, 375, 376, 377, 206/378, 493, 564, 565; 211/70.6, 162; 220/735, 752, 768, 646, 650, 670; 108/25, 26, 28

[56] References Cited

U.S. PATENT DOCUMENTS

| | | | |
|---|---|---|---|
| 42,949 | 5/1864 | Johnson | 220/646 |
| 242,120 | 5/1881 | Eastman | 206/564 |
| 434,321 | 8/1890 | Cornish | 220/650 |
| 1,617,493 | 2/1927 | Miller | 220/768 |
| 2,329,970 | 9/1943 | Zimmerman | 220/670 |
| 2,702,626 | 2/1955 | Nuttle | 220/768 |
| 2,707,052 | 4/1955 | Brown . | |
| 3,837,477 | 9/1974 | Boudreau | 206/564 |
| 3,904,034 | 9/1975 | Saunders . | |
| 3,966,103 | 6/1976 | Abrams | 206/565 |
| 4,150,746 | 4/1979 | Buglione | 206/378 |
| 4,337,860 | 7/1982 | Carrigan . | |
| 4,353,465 | 10/1982 | Rado . | |
| 4,650,077 | 3/1987 | Droz | 206/564 |
| 4,688,672 | 8/1987 | Pemberton . | |
| 4,705,168 | 11/1987 | Ward | 206/376 |
| 4,714,158 | 12/1987 | Oltman et al. | 206/378 |
| 4,826,021 | 5/1989 | Burrell . | |
| 4,927,020 | 5/1990 | Randy . | |
| 4,941,571 | 7/1990 | Barrett et al. . | |
| 4,987,998 | 1/1991 | Tsai . | |
| 4,997,085 | 3/1991 | Brennan | 206/376 |
| 5,050,733 | 9/1991 | Brennan | 206/376 |

FOREIGN PATENT DOCUMENTS

| | | | |
|---|---|---|---|
| 2412465 | 8/1979 | France | 206/565 |

*Primary Examiner*—David T. Fidei
*Attorney, Agent, or Firm*—Emrich & Dithmar

[57] ABSTRACT

The portable socket holder comprises a corrugated base plate, a plurality of rails attached to raised sections, a handle attached to the center of the plate, and a plurality of socket-receiving clips frictionally and slidably carried by the rails.

8 Claims, 1 Drawing Sheet

PORTABLE SOCKET HOLDER

This is a continuation of application Ser. No. 07/856,362, filed Mar. 23, 1992 now abandoned.

BACKGROUND OF THE INVENTION

A portable socket holder currently in the marketplace includes a flat, metal plate, several parallel rails attached thereto and a plurality of socket-receiving clips slid onto the rails. A handle is attached to one end of the plate. Such plate is not sufficiently rigid. Also, because the handle is at an end of the plate, it is vertically oriented when carried and the sockets may fall off.

SUMMARY OF THE INVENTION

It is a general object of the present invention to provide a portable socket holder which avoids the disadvantages of prior portable socket holders while affording additional structural advantages.

Another object is to provide a socket holder including a base plate having improved rigidity.

Another object is to provide a socket holder including a handle centrally on the base plate to prevent the sockets from falling off.

In summary, there is provided a portable socket holder comprising a corrugated base plate including a plurality of alternating first and second elongated sections, a plurality of rails disposed substantially parallel to each other and extending across the sections and being attached to the first sections, a plurality of socket-receiving clips frictionally and slidably carried by the rails, and a handle attached to the center of the base plate.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
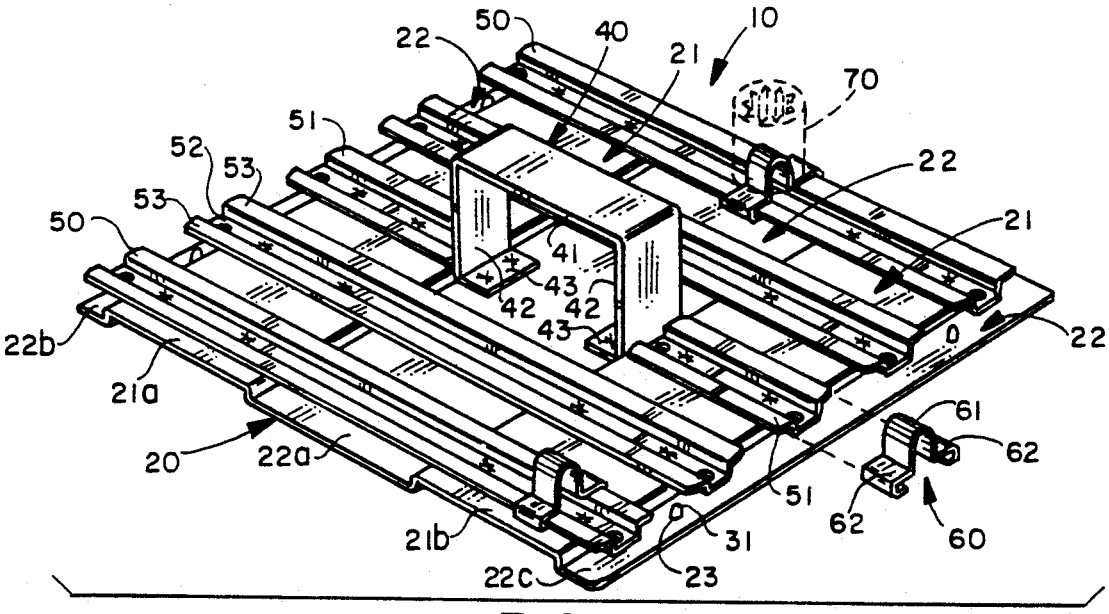
FIG. 1 is a perspective view of a portable socket holder constructed in accordance with the features of the present invention.
Figure 2:
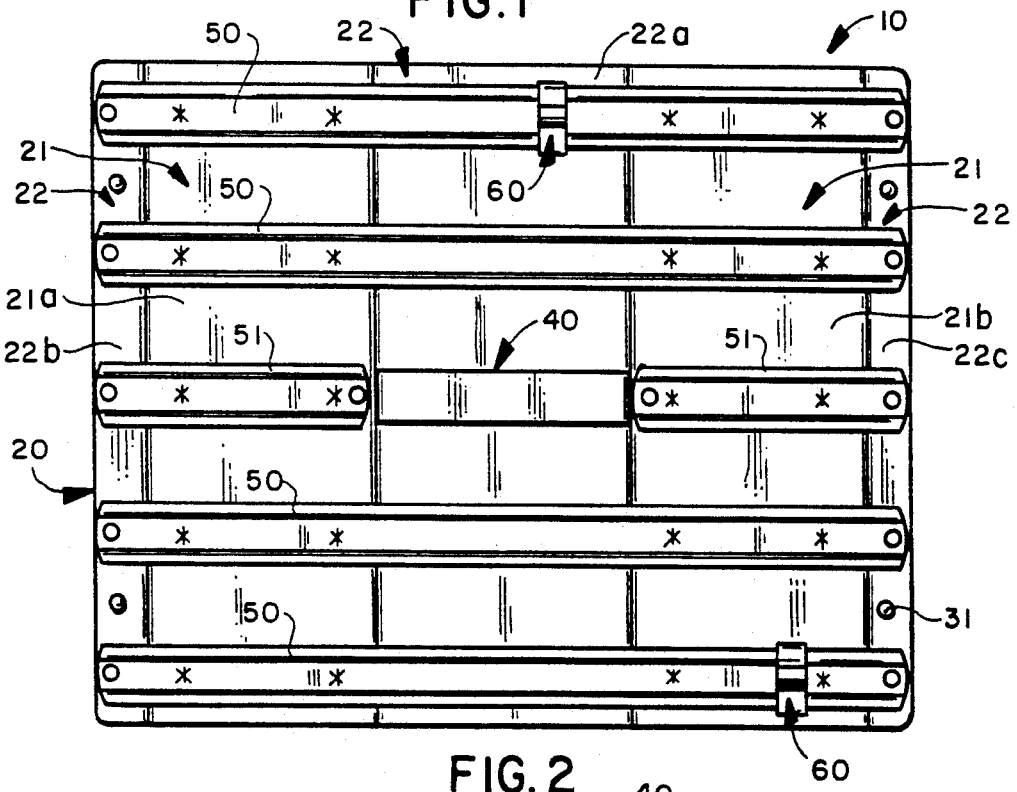
FIG. 2 is a plan view of the socket holder.

Turning now to FIGS. 1 and 2, there is depicted a portable socket holder 10 constructed in accordance with the present invention. The holder 10 comprises a corrugated base plate 20 which preferably is composed of zinc-coated metal. Plate 20 is defined by a plurality of alternating raised sections 21 and recessed sections 22 which extend the length of such plate. More particularly, plate 20 includes a centrally located, recessed, flat section 22*a* disposed between two raised flat sections 21*a* and 21*b* and also includes two peripheral, recessed flat sections 22*b* and 22*c* on the outsides of sections 21*a* and 21*b*, respectively. The surfaces of sections 21*a* and 21*b* are coplanar, and the surfaces of sections 22*a, b* and *c* are coplanar. Sections 21*a*, 21*b* and 22*a* preferably have the same width. Sections 22*b* and 22*c* preferably have the same width, although substantially narrower than sections 21*a, b, c*. The corrugated construction of plate 20 improves its rigidity in the direction parallel to the axes of such sections.

Figure 3:
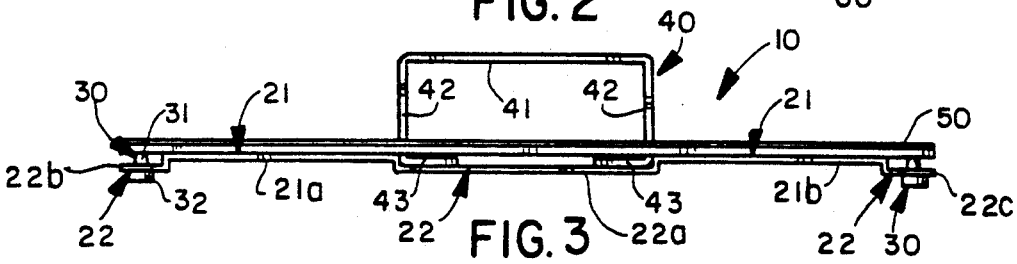
FIG. 3 is a side elevational view of the socket holder.

Referring also to FIG. 3, holder 10 comprises four feet 30 preferably made of rubber. Each foot includes a finger 31 and a circular base 32, such fingers frictionally extending through holes in sections 22*b and c*.

Holder 10 further comprises a C-shaped, unitary handle 40 including a hand-grasping leg 41, two side legs 42 depending therefrom and two fingers 43 extending inwardly from legs 42. Handle 40 is attached to the center of section 22*a* and extends the width thereof. Fingers 43 are attached as by welding. Because handle 40 is at the center of plate 20, holder 10 remains level when it is carried, thereby assuring that sockets stored thereon do not fall off.

Holder 10 also comprises four long rails 50 and two short rails 51. Each rail includes a bight portion 52 and a pair of outwardly extending wings 53. The rails are equidistantly spaced and are disposed across sections 21 and 22. Rails 51 are aligned with each other and are disposed centrally on plate 20. Handle 40 is between rails 51 and the three elements are aligned. Rails 51 are attached, as by welding, to the upper surfaces respectively of sections 21*a* or 21*b*, thereby improving the rigidity of plate 20 in the direction parallel to the axes of rails 50 and 51. The corrugated construction of plate 20 and the rails thereacross cause plate 20 to have improved rigidity in both directions, and thus reduce any tendency of the plate to sag. Two rails 50 are disposed on one side of the handle 40 and two rails 50 are disposed on its other side. Rails 50 extend the length of plate 20. The ends of rails 50 and 51 are spaced from sections 22*b* and 22*c* (FIG. 3).

Holder 10 further comprises a plurality of standard clips 60, each including a central inverted U-shaped portion 61 and a pair of C-shaped wings 62 which frictionally and slidably receive wings 53 of rails 50 and 51. Portion 61 is resilient and is shaped and sized to receive a socket 70. The space between peripheral recessed sections 22*b* and 22*c* and rails 50 and 51 allows a user to slip clips 60 onto the rails with ease.

What has been described, therefore, is a portable socket holder comprising a base plate which is corrugated and attached to cross rails for improved rigidity, and a handle centrally disposed on the base plate so that it is kept level when carried. While a particular embodiment of this invention has been described, it is to be understood that changes can be made in such embodiment without departing from the spirit and scope of the invention as defined in the claims.

What is claimed is:

1. A socket holder comprising a corrugated base plate having opposite sides, one of said sides including a plurality of alternating first and second elongated sections respectively defining first and second elongated surfaces with said first surfaces spaced from said second surfaces, a plurality of rails disposed substantially parallel to each other and extending substantially perpendicular to the direction of elongation of said surfaces and being attached to only said first surfaces and being spaced from said second surfaces, and a plurality of socket-receiving clips frictionally and slidably carried by said rails.

2. The socket holder of claim 1, wherein there are two first surfaces and three second surfaces.

3. The socket holder of claim 2, wherein each of said first surfaces and the second surface disposed therebetween have substantially the same width, and each of the other two second surfaces has a lesser width.

4. The socket holder of claim 3, further comprising a plurality of feet attached to said other two second sections.

5. A socket holder comprising a base plate having an obverse side, a plurality of rails disposed substantially parallel to each other and being attached to the obverse side of said base plate, a plurality of socket-receiving clips frictionally and slidably carried by said rails, one of said rails disposed centrally of said plate and including two spaced-apart sections aligned along a common axis and respectively having facing inner ends, and a handle attached to said base plate generally centrally of the obverse side thereof, said handle being disposed between said sections of said one rail and extending along said axis and having ends respectively disposed adjacent to the inner ends of said sections.

6. A socket holder comprising a corrugated base plate including a plurality of alternating first and second elongated sections each having a substantially flat surface, there being two first sections and three second sections alternating therewith, a plurality of rails disposed substantially parallel to each other and extending substantially perpendicular to the direction of elongation of said sections and being attached to the surfaces of said first sections, a plurality of socket-receiving clips frictionally and slidably carried by said rails, and a handle attached to said base plate generally centrally thereof and being coextensive with the width of the one of said second sections between said first sections.

7. The socket holder of claim 6, wherein two of said rails are aligned with each other and said handle, and are respectively disposed adjacent to the opposite ends of said handle.

8. The socket holder of claim 6, and further comprising a plurality of feet attached to the other two of said second sections.

* * * * *